United States Patent [19]

Miki

[11] 3,962,831

[45] June 15, 1976

[54] AUTOMATIC GRINDING METHOD AND APPARATUS FOR WOOD WORKING

[75] Inventor: Akira Miki, Fujimi, Japan

[73] Assignees: Sanko Mokkoki Co., Ltd.; Western Trading Co., Ltd., both of Tokyo, Japan

[22] Filed: May 22, 1975

[21] Appl. No.: 580,070

[30] Foreign Application Priority Data

May 30, 1974 Japan ..... 49-60252

[52] U.S. Cl. ..... 51/78; 51/134.5 R; 51/165.87

[51] Int. Cl.[2] ..... B24B 7/00

[58] Field of Search ..... 51/78, 165.87, 165.88, 51/134.5 R

[56] References Cited

UNITED STATES PATENTS

| | | | |
|---|---|---|---|
| 1,694,437 | 12/1928 | Bottger | 51/78 X |
| 1,995,382 | 3/1935 | Fenton | 51/78 X |
| 3,222,823 | 12/1965 | Seidel | 51/165.87 |
| 3,768,350 | 10/1973 | Coulter | 51/165.87 |

*Primary Examiner*—Harold D. Whitehead

[57] ABSTRACT

An automatic grinding apparatus for wood working comprising means for maintaining substantially constant the contact pressure between a grinding wheel and a material to be ground and the peripheral speed thereof irrespective of abrasion of the grinding wheel. The means for maintaining the contact force constant comprises a grinding wheel swinging means and a grinding wheel compensating means. The former includes a swing arm pivotally mounted on a slider for swinging movement and carrying rotatably a grinding wheel shaft at the free end, and a cylinder means for swinging the swing arm toward and away from the material. The latter includes a means for detecting the angular displacement of the swing arm due to abrasion of the grinding wheel and a slider moving means for advancing the slider toward the material until the swing arm restores to its initial angular position. The means for maintaining the peripheral speed of the grinding wheel constant includes a self-adjusting pulley at the driven side which is so designed that change in the distance between both drive and driven shafts due to the forward movement of the slider causes decrease in the effective diameter of the pulley to increase the speed of the grinding wheel.

9 Claims, 5 Drawing Figures

AUTOMATIC GRINDING METHOD AND APPARATUS FOR WOOD WORKING

BACKGROUND OF THE INVENTION

This invention relates to method and apparatus for grinding automatically wood materials or the like by means of a grinding wheel.

In general, various types of surface grinding methods for wood are known. Preferably, a grinding wheel for wood working is of such hardness that is is worn out to the desired degree relative to the hardness of wood by grinding operation, and hence the grinding wheels which are relatively fast at the rate of abrasion are used. As is widely known, the extremely high hardness of a grinding wheel with respect to the hardness of wood causes loading in the grinding wheel and proper grinding can not be effected.

Accordingly, the grinding wheel for use in the continuous grinding of the material to be ground will be considerably rapidly worn out. For that reason, the operator had to compensate the wearing distance of such grinding wheel by bringing it close to the material by hand. Further, the manipulation of a handle for feeding the grinding wheel forward corresponding to slight abrasion thereof required tolerable skill in the operator and was a difficult operation. Because, change in the contact pressure between the grinding wheel and the material to be ground caused different grinding effects. Further, change in the peripheral speed of the grinding wheel due to the decrease in diameter also resulted in uneven grinding operation.

BRIEF SUMMARY OF THE INVENTION

Accordingly, it is an object of the invention to provide automatic grinding method and apparatus for wood working which permit the contact pressure between a grinding wheel and a material to be ground to be maintained substantially constant.

It is another object of the invention to provide automatic grinding method and apparatus which permit the peripheral speed of the grinding wheel to be maintained substantially constant for proper and uniform grinding.

It is a further object of the invention to provide an automatic grinding apparatus in which the grinding wheel is somewhat movable in the axial direction to follow any cambers or curves on the material to be ground for grinding.

It is a still further object of the invention to provide an automatic grinding apparatus having means for bringing properly the grinding wheel into and out of engagement with the material in the predetermined grinding section to prevent the excessive grinding at the end of the material.

BRIEF DESCRIPTION OF THE DRAWINGS

These and other objects, features and advantages of the invention will become more apparent upon a reading of the following detailed specification and drawings, in which.

DETAILED DESCRIPTION OF THE PREFERRED EMBODIMENTS

Figure 1:
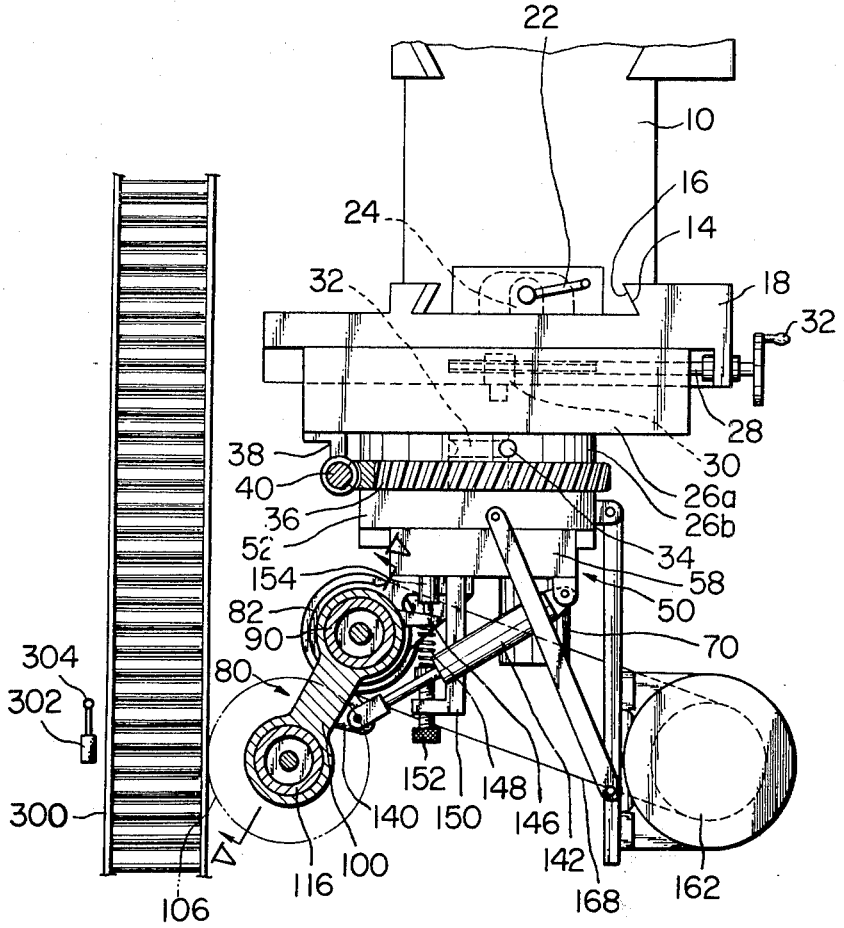
FIG. 1 is a schematic plan view, partly in section, of an automatic grinding apparatus according to the invention.
Figure 2:
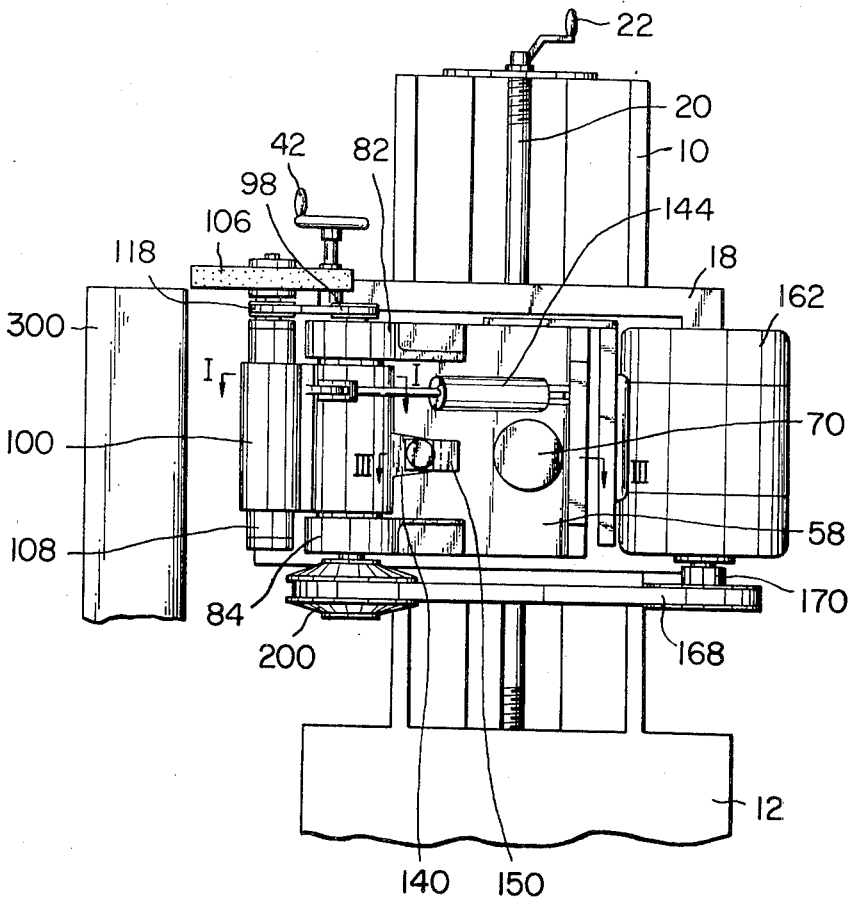
FIG. 2 is a schematic front view of the apparatus shown in FIG. 1.

Fererring to FIGS. 1 and 2, a column 10 is fixedly mounted on a base 12. Although two similar grinding apparatuses are provided on both sides of the column 10, only one of them will be explained for simplification. A dovetail guide 14 is formed on a side of the column 10 and a sliding plate 18 having a dovetail groove 16 corresponding to the dovetail guide 14 is fitted thereon for vertical sliding movement. As is best seen from FIG. 2, a screw shaft 20 extending vertically along the column 10 is rotatably mounted on the same. An internal thread 24 affixed to the sliding plate 18 threadably engages the screw of the screw shaft 20 and therefore turning of a handle 22 enables the sliding plate 18 to be vertically moved. Similarly, formed horizontally on the outer side of the sliding plate 18 is a further dovetail guide on which a first base plate 26a with a dovetail groove is slidably mounted. A screw shaft 28 rotatably mounted on the sliding plate 18 and an internal thread 30 affixed to the first base plate 26a engage with each other, so that turning of a handle 32 enables the first base plate **26*a* to be moved horizontally. A second base plate 26*b* is mounted by means of a pin 34 for rotation about a stationary shaft 32 projecting from the first base plate 26*a*. Fixedly secured to the second base plate 26b concentrically with the stationary shaft 32 is a worm wheel 36 which engages a worm 40 rotatably supported on the first base plate 26*a* by brackets 38. Therefore, turning of a handle 42 enables the second base plate 26*b* to be rotated about the shaft 32.**

Then, a slider moving means 50 will be explained below. The slider moving means 50 constitutes a grinding wheel compensating means according to the invention together with a means for detecting the angular displacement of a swing arm which will be described later.

Figure 3:
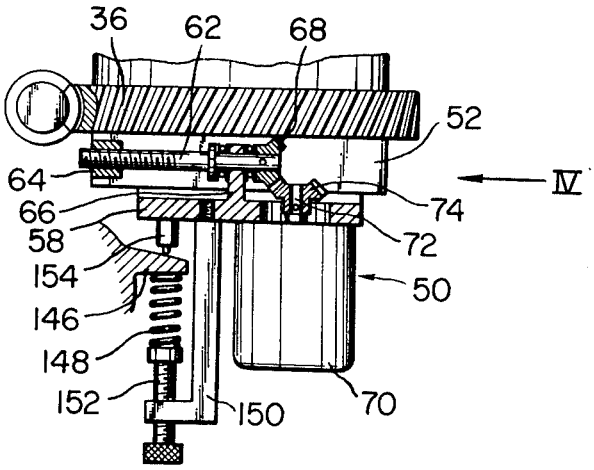
FIG. 3 is a fragmentary sectional view of a grinding wheel compensating means taken along the line III — III of FIG. 2.
Figure 4:
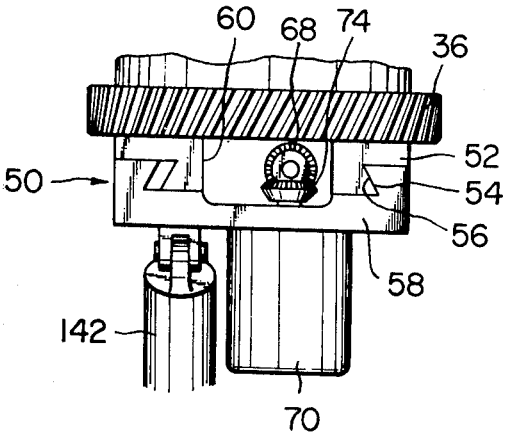
FIG. 4 is a fragmentary side view of the means shown in FIG. 3 as viewed from the direction of the arrow mark IV.

As is best seen from FIG. 4, a slider 58 having a dovetail groove 56 is mounted for horizontal sliding movement on a dovetail 54 formed so as to extend horizontally on a support frame 52 fixedly secured to the worm wheel 36. A screw shaft 62 extends through a cavity 60 formed in the support frame 52 in parallel relation to the dovetail 54. The screw shaft 62 is engaged at the threaded portion by an internal thread 64 fixedly secured to the support frame 52 and is rotatably journaled at the other portion by an arm 66 protruding from the slider 58. Referring to FIG. 3, a bevel gear 68 is firmly mounted on the end of the screw shaft 62 and engaged by another bevel gear 74 firmly mounted on a shaft 72 of a geared motor 70 secured to the slider 58. Accordingly, upon rotation of the motor 70, the screw shaft 62 is rotated and moved axially, whereby the slider 58 can be horizontally moved sliding on the support frame 52.

Now, a grinding wheel swinging means 80 will be explained below. The means 80 constitutes together with the grinding wheel compensating means a means for maintaing the contact pressure between the grinding wheel and the material substantially constant. To put it briefly, the grinding wheel swinging means 80 comprises a swing arm 100 pivotally connected to the slider 58 and rotatably carrying a shaft 114 for the grinding wheel 106 at the free end, and a cylinder means 142 for swinging the swing arm 100 toward and away from the material to be ground.

Figure 5:
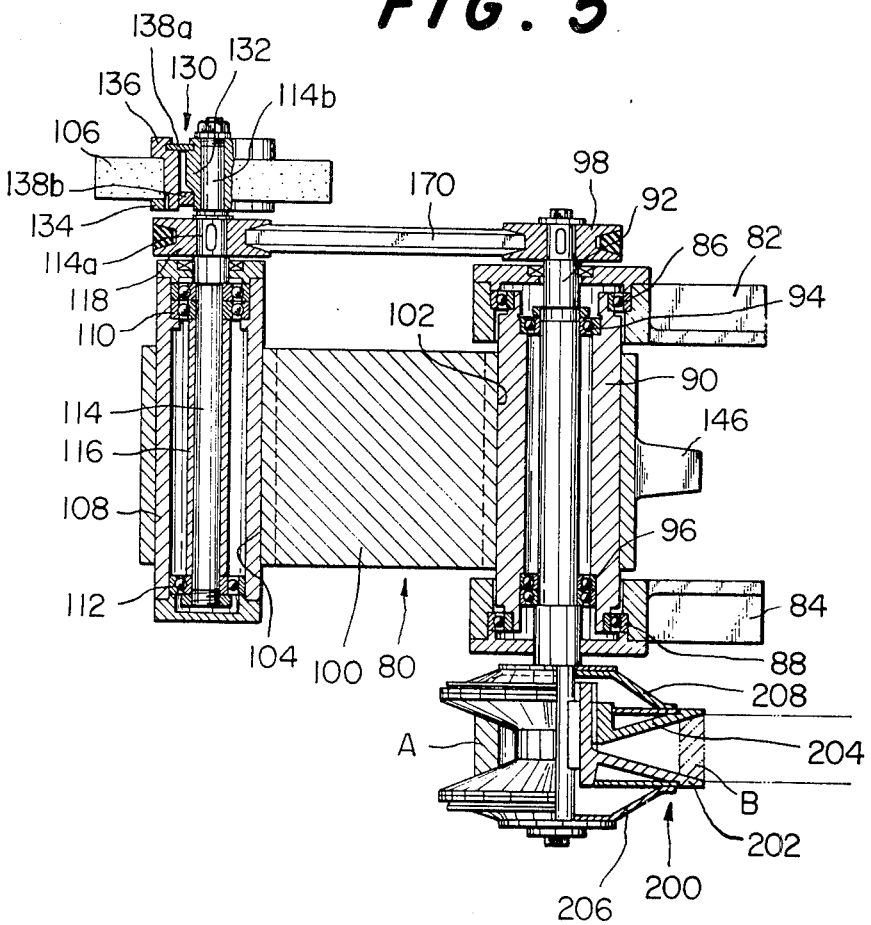
FIG. 5 is a longitudinal sectional view of a swing arm taken along the line V — V of FIG. 1.

Two bearing brackets are firmly mounted on the slider 58 at the side opposite to the motor 70. Referring to FIG. 5, a hollow tube 90 is rotatably supported by ball bearings 86 and 88 mounted within the brackets 82 and 84, respectively. A shaft 92 is rotatably journaled within the hollow tube 90 by ball bearings 94, 96. A V-pulley 98 is firmly mounted on the top end of the shaft 92 and a self-adjusting pulley 200 is mounted on the lower end of the shaft 92. The hollow tube 90 is press-fitted in one bore 102 of the swing arm 100, while another hollow tube 108 for the grinding wheel shaft 114 is press-fitted in the other bore 104 of the swing arm 100. A shaft 114 is rotatably journaled by ball bearings 110, 162 mounted within the hollow tube 108 and has a distance collar 116 interposed between the ball bearings 110 and 162. Firmly mounted on the shaft 114*a* protruding from the hollow tube 108 is a V-pulley 118 which is connected to the V-pulley 98 on the shaft 92 through a V-belt 170. Further, resilient means 130 for elastically supporting the grinding wheel 106 for some axial movement is provided at the shaft end 114*b*. The resilient means 130 comprises an inner ring 132 fixedly secured to the shaft end 114*b*, an outer ring 136 on which the grinding wheel 106 is firmly mounted by means of a nut 134, and annular resilient rings 138*a* and 138*b* for elastically supporting the grinding wheel 106 and interposed between the inner ring 132 and the outer ring 136. This resilient means 130 permits the grinding wheel 106 to be somewhat deflected in the axial direction on being subjected to any axial load.

Now, the swing arm 100 in which the grinding wheel shaft 114 and the transmission shaft 92 are supported has a lug 146 projecting from a point between both shafts 114 and 92. The cylinder means 142 is pivotally connected at the rear end of the cylinder to the slider 58 and at the front end of a piston rod to the swing arm 100, so that the swing arm 100 may be pivotally moved with the axis of the shaft 92 as a center by actuating the cylinder means 142. Further, the swing arm 100 is provided at the side of the transmission shaft 92 with another lug 146, which is urged counter-clockwise by means of a spring 148 as shown in FIG. 3. The biased force of the spring 148 may be adjusted by turning an adjusting screw 152 which threadably engages an end of a support stand 150 fixedly secured to the slider 58, and therefore the contact pressure between the grinding wheel 106 and the material to be ground may be suitably adjusted. A limit switch 154 is properly attached to the slider 58 in a position opposite to the lug 146 of the swing arm 100 and is adapted for operation at the time when the initially set position of the swing arm 100 with respect to the transmission shaft 92 has changed due to abrasion of the grinding wheel 106, that is to say, the swing arm 100 has been pivotally moved toward the material about the shaft 92 above the range of the predetermined angle. Upon rotation of the motor 70 with the operation of the limit switch 154, the slider 58 is advanced forward to compensate the wearing distance of the grinding wheel 106 so that the swing arm 100 restores to its original angular position, thereby causing the limit switch 154 to be turned off to stop the rotation of the motor 70.

The rotation of a motor 162 for the grinding wheel 106 is transmitted from a pulley 170 to the self-adjusting pulley 200 through a V-belt 168, and transmitted in turn from the V-pulley 98 on the upper end of the shaft 92 to the V-pulley 118 on the grinding wheel shaft 114 through a V-belt 170.

Now, the self-adjusting pulley 200 will be explained with reference to FIG. 5. This pulley 200 basically comprises two frames 202 and 204 defining a V-shaped peripheral groove in opposed relation to each other, with one frame 202 mounted on the shaft 92 for axial sliding movement by means of key and the other frame 204 mounted on a boss of the frame 202 for axial sliding movement by means of spline. Springs 206 and 208 are biased in abutting engagement with the rear sides of the frames 202 and 204, respectively to urge the frames toward each other. The width of the V-shaped groove may be automatically adjusted according to change in the distance between the motor shaft and the shaft 92. Namely, if the distance between both shafts is increased, the endless V-belt 168 is forced inwardly into the V-shaped groove of the self-adjusting pulley 200 as indicated by A in FIG. 5. On the contrary, if the distance between both shafts are decreased, the frames 202 and 204 are moved toward each other by means of the springs 206 and 208 so that the V-belt 168 are moved outwardly of the pulley 200 as indicated by B in FIG. 5. Thus, change in the distance between the motor shaft and the transmission shaft 98 enables the number of revolutions of the shaft 98 or the grinding wheel shaft 114 to be adjusted with respect to the constant number of revolutions of the motor shaft. In general, the decrease in diameter of the grinding wheel 106 due to abrasion will result in the decrease in the peripheral speed thereof. However, the self-adjusting pulley means according to the invention permits the peripheral speed of the grinding wheel to be compensated automatically. This will be explained with reference to FIGS. 1, 2 and 5. Upon operation of the limit switch 154, the motor 70 is rotated and the slider 58 is advanced forward the wearing distance of the grinding wheel 106. This increases the distance between the shaft 92 and the motor shaft and hence the V-belt 168 is forced inwardly into the V-shaped groove of the self-adjusting pulley 200 so that the effective diameter of the pulley 200 is decreased. Thus, the number of revolutions of the shaft 92 or the grinding wheel 106 connected thereto may be increased.

Referring to FIGS. 1 and 2, a roller conveyor 300 for transferring a material to be ground is positioned adjacent the grinding wheel 106. Each roller is rotated at a constant speed and pressure rollers (not shown) are arranged in the vicinity of the predetermined grinding section to press the material to be ground. Positioned adjacent the side of the roller conveyor 300 is a limit switch 302 for detecting the material being transferred on the roller conveyer 300. When a detecting bar 304 of the limit switch 302 has been pushed and tilted by the material being transferred, the limit switch 302 is turned on thereby causing the cylinder means 142 to be operated so as to pivotally move the swing arm 100 from the retracted position to the predetermined grinding position. The time adjustment of each member associated with the limit switches 154, 302 is performed by means of a control box (not shown).

In operation, a material to be ground is transferred on the roller conveyer 300, then enters under the pressure roller and is further transferred while being held therebetween under pressure. When the material comes in contact with the detecting bar 304 of the limit switch 302 and tilts the same, the limit switch 302 is turned on thereby causing the cylinder means 142 to be actuated so that the swing arm 100 is pivotally moved from the retracted position to the predetermined grinding position. Thus, the material being transferred on the roller conveyer 300 is ground by the rotating grinding wheel 106 under a constant pressure.

The continuous grinding operation causes the abrasion of the outer peripheral surface of the grinding wheel 106. Upon the occurrence of such abrasion, the grinding wheel 106 is pivotally moved toward the material with the shaft 92 as a center the wearing distance of the grinding wheel. When the swing arm 100 has been pivotally moved above the range of the predetermined angle, the lug 146 of the swing arm 100 depresses the limit switch 154 to thereby operate the motor 70. This causes the screw shaft 62 to be rotated so that the slider 58 is advanced on the support frame 52 toward the roller conveyer 300. Thus, the shaft 92 of the swing arm 100 is advanced forward until it restores to its initial angular position, and simultaneously the limit switch 154 is turned off to thereby stop the motor 70. In this way, the slider 58 may be advanced forward the wearing distance of the grinding wheel 106. This forward movement increases the distance between the transmission shaft 92 and the drive shaft of the motor 162, so that the V-belt 168 is forced inwardly into the V-shaped groove of the self-adjusting pulley 200 on the shaft 92 the distance the slider 58 is advanced, and the effective diameter of the driven pulley 200 is decreased. This means increase in number of revolutions of the transmission shaft 92 and hence the grinding wheel 106 connected thereto through the V-belt 170. Thus, as described above, the decrease in the peripheral speed of the grinding wheel 106 resulting from the decrease in diameter thereof due to abrasion may be compensated such that the peripheral speed is maintained substantially constant for proper uniform grinding.

Further, the difference in time between the time when a material was previously shaped and the time when the material is ground sometimes produces any camber or strain. In such case, the annular resilient rings 138*a*, 138*b* employed as means for elastically supporting the grinding wheel 106 permits the same to somewhat move along the shaft 114 to follow any vertical curves or cambers on the material to be ground. On the other hand, horizontal curves or cambers on the material, which may be normally absorbed by the elasticity of air in the pneumatic mechanism comprising the air cylinder means 142, are usually extremely small and hence will not cause the operation of the limit switch 154. This means that in the range of the predetermined angle from the initially set position, the swing arm 100 presses the grinding wheel 106 against the material substantially at a constant pressure, but on exceeding such range, the limit switch 154 is adapted for operation. In this way, uniform grinding can be effected. Therefore, any cambers on the material to be ground in such predetermined range may be followed by slight pivotal movement of the swing arm 100 irrespective of the limit switch 154. Finally, when the material has been released from contact with the limit switch 302, the grinding wheel 106 at the end of the material is automatically pivotally moved from the grinding position to the retracted position by operation of the cylinder means 142. This prevents any excessive grinding at the end of the material from occuring.

As described in the embodiment, the invention eliminates the disadvantages in the prior art stated at the beginning of the specification and provides superior effect. Further, the apparatus according to the invention permits continuous automatic grinding operation and is considerably effective as a grinding apparatus for use during a series of operations for shaping cabinets or the like. Thus the apparatus can be used as a link in the chain of blow process to provide superior capacity.

While the described embodiment represents the preferred form of the present invention, it is to be understood that modifications will occure to those skilled in the art without departing from the spirit of the invention. The scope of the invention is therefore to be determined solely by the appended claims.

What is claimed is:

1. An automatic grinding apparatus for wood working, comprising a column; a base plate mounted on said column for vertical and horizontal movement and for rotation; a slider mounted on said base plate for horizontal sliding movement; a means for swinging a grinding wheel, said means including a swing arm pivotally connected at one end to said slider and carrying at the other free end a grinding wheel shaft, and a means for swinging said swing arm toward and away from a material to be ground; and a grinding wheel compensating means including a means for detecting angular displacement of the swing arm above the range of the predetermined angle due to abrasion of the grinding wheel and a means for advancing the slider toward the material the wearing distance of the grinding wheel until the swing arm restores to its initial angular position.

2. An apparatus as set forth in claim 1, further including a self-adjusting pulley means for increasing number of revolutions of the grinding wheel decreased in diameter due to abrasion to maintain the peripheral speed thereof substantially constant, simultaneously with said advancing movement of the slider toward the material.

3. An apparatus as set forth in claim 1, said means for swinging the swing arm with respect to the material including a cylinder means pivotally connected at one end to the slider and at the other end to the swing arm.

4. An apparatus as set forth in claim 3, said means for detecting the angular displacement of the swing arm including a lug projecting from the swing arm and a limit switch arranged in opposite relation to said lug.

5. An apparatus as set forth in claim 4, said slider moving means including a motor mounted on said slider, a screw shaft threadably engaged at one portion by the base plate and rotatably journaled at the other portion by said slider, and a means for transmitting a power from the motor to the screw shaft.

6. An apparatus as set forth in claim 2, said self-adjusting pulley means including a motor mounted on said base plate, a transmission shaft mounted on said swing arm in the center of pivotal movement, a means for transmitting a power from said transmission shaft to the grinding wheel shaft, a self-adjusting pulley mounted on said transmission shaft and a means for transmitting a power from the motor to said self-adjusting pulley.

7. An apparatus as set forth in claim 6, said self-adjusting pulley comprising two frames mounted on said transmission shaft for axial sliding movement with each other and defining a V-shaped groove therebetween, and resilient means for urging said frames toward each other.

8. An apparatus as set forth in claim 1, further including a conveyer arranged adjacent the grinding wheel on said grinding wheel shaft journaled in said swing arm, and a limit switch positioned adjacent said conveyer to detect the material thereon for grinding operation, whereby upon contact of the limit switch with the material, the swing arm is pivotally moved from the retracted position to the grinding position and upon release from contact of the limit switch with the material said swing arm restores to its initial angular position.

9. An apparatus as set forth in claim 1, further including annular resilient means interposed between the grinding wheel and the shaft thereof, whereby said grinding wheel can be somewhat moved in the axial direction.

* * * * *